US005706927A

United States Patent [19]

Okitani et al.

[11] Patent Number: 5,706,927

[45] Date of Patent: Jan. 13, 1998

[54] TOKEN DISCRIMINATING DEVICE

[75] Inventors: Genichiro Okitani; Takashi Kumabe, both of Tokyo-to; Norio Tone, Yamato; Takashi Hamano, Kawasaki, all of Japan

[73] Assignee: Konami Co., Ltd., Hyogo-ken, Japan

[21] Appl. No.: 532,446

[22] Filed: Sep. 22, 1995

[30] Foreign Application Priority Data

Sep. 22, 1994 [JP] Japan ..... 6-252761

[51] Int. Cl.[6] ..... G07D 3/04

[52] U.S. Cl. ..... 194/334; 453/15

[58] Field of Search ..... 194/334, 338; 453/5, 9, 14, 15

[56] References Cited

U.S. PATENT DOCUMENTS

| | | | |
|---|---|---|---|
| 1,556,477 | 10/1925 | Bellows | 194/338 |
| 4,676,358 | 6/1987 | Rosendahl | 194/334 X |
| 4,911,280 | 3/1990 | Bruner | 453/9 X |
| 4,987,989 | 1/1991 | Buckenham et al. | 194/334 X |

FOREIGN PATENT DOCUMENTS

| | | | |
|---|---|---|---|
| 0288955 | 2/1988 | European Pat. Off. . | |
| 154766 | 4/1903 | Germany . | |
| 30070484 | 9/1981 | Germany . | |
| 6059632 | 1/1982 | Japan . | |
| 358489 | 6/1991 | Japan . | |
| 374468 | 6/1932 | United Kingdom | 194/338 |

*Primary Examiner*—F. J. Bartuska
*Attorney, Agent, or Firm*—Jordan and Hamburg

[57] ABSTRACT

A token discriminating device includes: a rolling member having two guide walls and a bottom for defining a rolling passage in which a token is rolled; and a smaller unacceptable token discriminating portion having: a cut-away portion formed in one of the two guide walls; a deflective wall provided in an upper portion of the cut-away portion to define a discriminating opening, a discriminating distance between the bottom and a lower end of the deflective wall being smaller than the diameter of an acceptable token, the deflective wall being bent outward of the rolling passage; a deflector provided on the other guide wall at a position facing the discriminating opening for deflecting a rolling token to the discriminating opening.

13 Claims, 4 Drawing Sheets

TOKEN DISCRIMINATING DEVICE

BACKGROUND OF THE INVENTION

This invention relates to a token discriminating device, particularly to a token discriminating device which is disposed in a token chute portion of a token game machine to discriminate acceptable tokens from unacceptable tokens according to the size of token.

There have been proposed several token discriminating devices. For example, Japanese Examined Patent Publication No. 60-59632 discloses a token discriminating device for use in an automatic vending machine.

Specifically, there is provided a rolling member for rolling a token. The rolling member is formed with a rolling passage in which tokens are rolled down. The rolling passage is an enclosed space which is defined by two guide walls, top wall, and bottom wall. The two guide walls face each other and extend in parallel with each other over the entire length. One of the guide walls is formed with a cut-away portion in an appropriate portion thereof to discriminate off unacceptable tokens having a diameter smaller than the diameter of an acceptable token. The cut-away portion is in the form of a square having lengths and heights slightly smaller than the diameter of an acceptable token. Further, the other guide wall is provided with a braking member at a position facing the cut-away portion. The braking member is pivotable about a vertical axis. The braking member receives a rolling token, slowing the rolling speed of the token, and then pushing the token to the cut-away portion together with a pivotal motion of the braking member.

The rolling member is declined in a rolling direction in entirety so that a token rolls down by its weight. Also, the rolling member is inclined in a vertical plane perpendicularly intersecting the rolling direction in such a manner that the guide wall having the cut-away portion faces downward. A token is inserted and rolled in the rolling passage. The braking member then slows and pushes the rolling token to the cut-away portion. An acceptable token having the diameter larger than the size of the cut-away portion passes the cut-away portion while an unacceptable token having a diameter smaller than the size of the cut-away portion cannot pass the cut-away portion and consequently falls from the cut-away portion by its weight. In this way, unacceptable tokens are discriminated off.

In this token discriminating device, however, there is the likelihood that when the rolling member is inclined in the reverse direction in the vertical plane due to a failure in installation of a machine provided with this discriminating device, and the guide wall having the cut-away portion consequently comes into a vertical position, unacceptable tokens may not fall from the cut-away portion accurately.

Also, the braking member is made to be pivotal in the vertical axis. Accordingly, in the state where the rolling member is inclined in the vertical plane, there is the likelihood that the braking member does not pivot smoothly and the rolling token is stopped at the braking member. Further, the braking member is provided in the rolling passage having the parallel guide walls. The portion where the braking member is provided is narrower than the other portion of the rolling passage. Accordingly, maloperation of the pivotal braking member increases the likelihood of stopping or jamming tokens.

Japanese Unexamined Utility Model Publication No. 3-58489 discloses a token discriminating device which is provided with a solenoid-driven pushing mechanism. This pushing mechanism ensures forcible pushing of unacceptable tokens irrespective of inclination of guide walls, but needs more complicated construction, which thus increases the production costs. Also, the arrangement of the solenoid-driven pushing mechanism requires frequent maintenance services to assure a long operation, consequently increasing the running costs.

SUMMARY OF THE INVENTION

It is an object of the present invention to provide a token discriminating device which has overcome the problems residing in the prior art.

It is another object of the present invention to provide a token discriminating device which can discriminate unacceptable tokens reliably irrespective of installation conditions of a game machine.

It is another object of the present invention to provide a token discriminating device which can reliably perform token discrimination for a longer time at a reduced cost.

The present invention is directed to a token discriminating device comprising: a rolling member including two guide walls and a bottom for defining a rolling passage in which a token is rolled; and a smaller unacceptable token discriminating portion including: a cut-away portion formed in one of the two guide walls; a deflective wall provided in an upper portion of the cut-away portion to define a discriminating opening, a discriminating distance between the bottom of the rolling member and a lower end of the deflective wall being smaller than the diameter of an acceptable token, the deflective wall being bent outward of the rolling passage: a deflector provided on the other guide wall at a position facing the discriminating opening for deflecting a rolling token to the discriminating opening.

The deflective wall may be preferably constructed by a band member bent outward of the rolling passage; and a supporting portion which is formed in an upper portion of the cut-away portion and supports the band member slidably in the height direction of the guide wall.

It may be appreciated that the deflector is fixedly provided on the other guide wall.

Further, it may be appreciated to form a larger unacceptable token discriminating portion in the rolling member on an upstream of the smaller unacceptable token discriminating portion. The larger unacceptable token discriminating portion may be defined by providing two restrictive members in an upstream end of the rolling passage, and spacing the two restrictive members by distance slightly larger than the diameter of an acceptable token. It may be preferable to make one of the two restrictive members fixed and make the other restrictive member movable.

With thus constructed token discriminating device, the outward-bent deflective wall is provided in an upper portion of the cut-away portion to define the discriminating opening and the deflector is provided on the opposite guide wall. Rolling tokens are deflected or inclined to the discriminating opening from which unacceptable tokens then fall by the weight. Acceptable tokens roll along the deflective wall and then rolls in the main rolling passage. Accordingly, even in the state where the deflector is projected in the rolling passage, the deflective wall permits tokens to roll down smoothly, and eliminates the likelihood that tokens is stopped by the deflector.

The deflective wall is constructed by the band member slidably supported by the support portion. Accordingly, the space of the discriminating opening can be desirably changed, and a variety of tokens having different sizes can be thus discriminated by one rolling member.

The deflector is fixedly provided on the other guide wall. This will simplify the construction of the token discriminating device and ensure a prolonged operation without maintenance service, thus enabling lower production and running costs.

Also, the larger unacceptable token discriminating portion is formed on an upstream of the smaller unacceptable token discriminating portion. Accordingly, unacceptable tokens having larger diameters that the diameter of the acceptable token can be discriminated off in addition to the discrimination of the smaller unacceptable tokens.

The larger unacceptable token discriminating portion is defined by two restrictive members only. Accordingly, its construction is very simple. Also, since one of the two restrictive members is made to be movable, the size of the discriminating opening can be changed easily by moving the movable restrictive member.

These and other objects, features and advantages of the present invention will become more apparent upon a reading of the following detailed description and drawings.

DETAILED DESCRIPTION OF THE PREFERRED EMBODIMENT OF THE INVENTION

Figure 1:
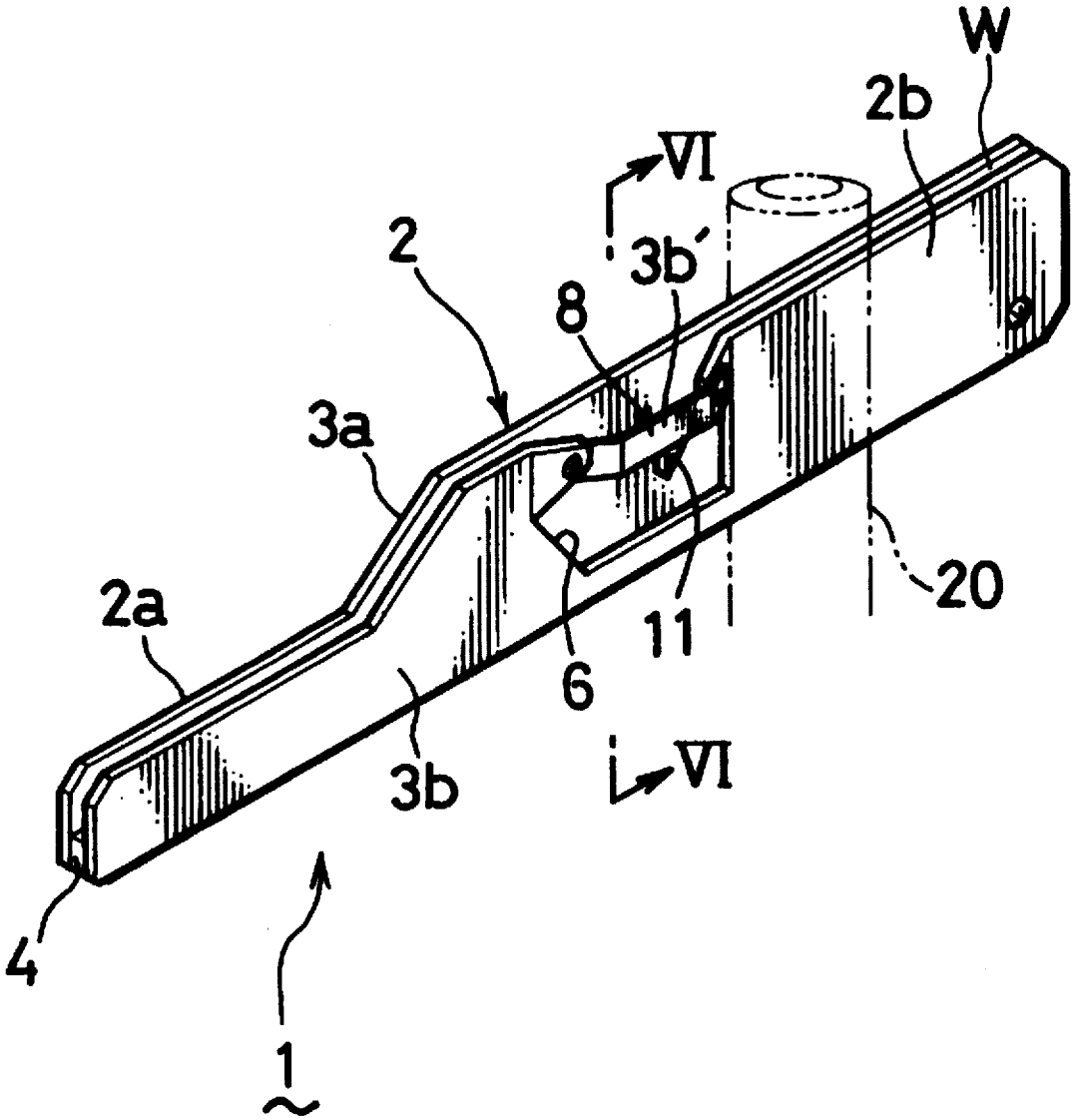
FIG. 1 is a perspective view showing a token discriminating device embodying the present invention.

A token discriminating device embodying the invention will be described with reference to the accompanying drawings.

The token discriminating device 1 includes a rolling member 2 which is in the form of a channel and has a specified length in a rolling direction. A token is rolled in the rolling member 2. The rolling member 2 is supported by a support pole 20 in a posture of declining in such an angle that a token rolls down by its weight.

Specifically, the rolling member 2 includes guide walls 3*a*, 3*b* and a bottom member 4. The guide walls 3*a*, 3*b* face each other at a specified gap. The gap between the guide walls 3*a*, 3*b* is slightly larger than the thickness of the token to be rolled down in the rolling member 2. The bottom member 4 is disposed at a bottom of the guide walls 3*a*, 3*b* and connect the guide walls 3*a*, 3*b* to each other. The guide walls 3*a*, 3*b* and the bottom member 4 define a rolling passage 5 in which a token is to be rolled.

The rolling member 2 has an outlet portion 2*a* and an inlet/discriminating portion 2*b*. The guide walls 3*a*, 3*b* in the outlet portion 2*a* are made to have a height smaller than the diameter of an acceptable token so that the passing of the token can be checked.

The inlet/discriminating portion 2*b* is provided with a larger unacceptable token discriminating portion A and a smaller unacceptable token discriminating portion B. The larger unacceptable token discriminating portion A is located on upstream of the smaller unacceptable token discriminating portion B.

Figure 2:
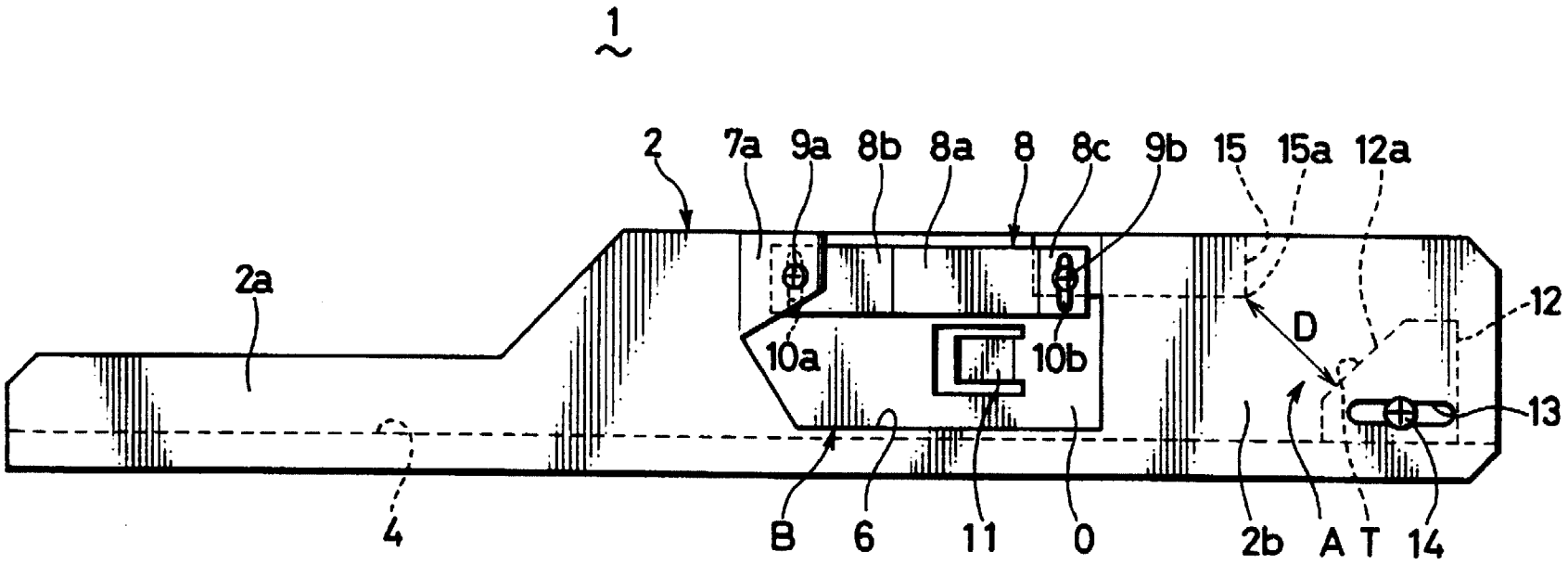
FIG. 2 is a front view of the token discriminating device.
Figure 3:
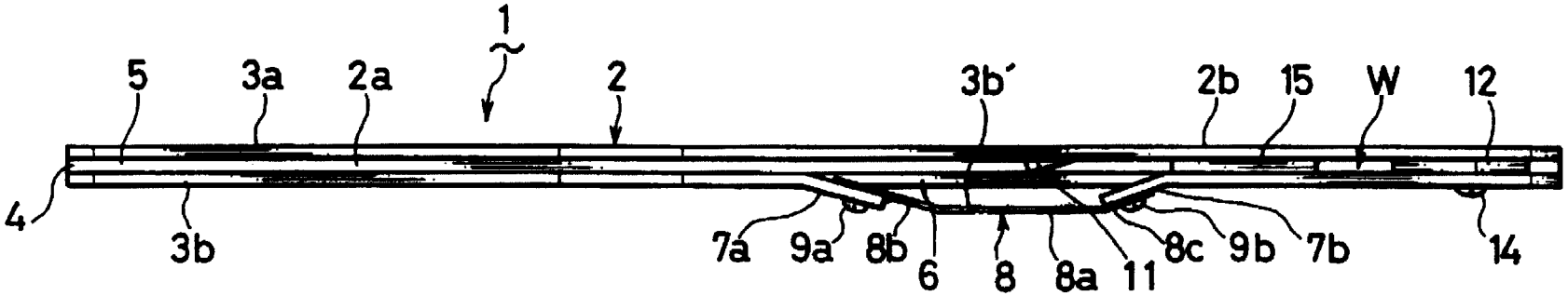
FIG. 3 is a top plan view of the token discriminating device.
Figure 4:
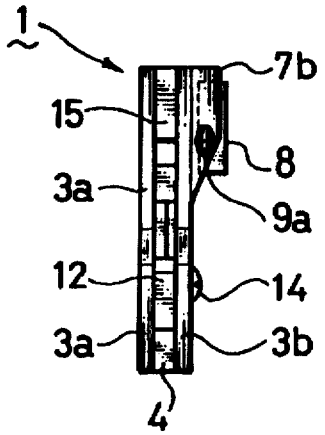
FIG. 4 is a left side view of the token discriminating device.

As shown in FIG. 2, the larger unacceptable token discriminating portion A is defined by a lower restrictive member 12 and an upper restrictive member 15. The two restrictive members 12 and 15 are placed in the gap between the guide walls 3*a*, 3*b*.

The lower restrictive member 12 is disposed on an inlet end portion of the bottom member 4 of the rolling member 2, and generally has a trapezoid shape. The lower restrictive member 12 is releasably attached on the guide walls 3*a*, 3*b* by a screw 14 passing an oblong hole 13 formed in the guide wall 3*b*. The lower restrictive member 12 is permitted to slide on the bottom member 4 in a lengthwise direction of the rolling member 2 within a length of the oblong hole 13 by releasing the screw 14.

The upper restrictive member 15 is disposed in an upper portion of the inlet end portion of the rolling member 2 and downstream of the lower restrictive member 12, and has a rectangular shape. The upper restrictive member 15 is fixedly attached on the guide walls 3*a*, 3*b*.

The lower and upper restrictive members 12 and 15 are spaced from each other so that a token inlet passage W is defined between them. The token inlet passage W has a discriminating throat T which is defined by a smallest space between a lower right corner 15*a* of the upper restrictive member 15 and a slanting surface 12*a* of the lower restrictive member 12. The space distance D of the discriminating throat T is equal to or slightly larger than the diameter of an acceptable token. Tokens having a diameter larger than the space distance D are kept from passing while tokens having a diameter equal to or smaller than the space distance D are permitted to pass. In this way, unacceptable tokens having a diameter larger than the diameter of an acceptable token are discriminated off. The space distance D is changed by sliding the lower restrictive member 12.

The smaller unacceptable token discriminating portion B is defined by a cut-away portion 6 formed in an intermediate of the guide wall 3*b*, a deflective wall 3*b*', and a deflector 11 formed in an intermediate of the guide wall 3*a*.

The cut-away portion 6 has a length equal to or slightly larger than the diameter of the acceptable token. A lower end of the cut-away portion 6 is positioned slightly higher than a top surface of the bottom member 4 so that a low guide wall exists in a lower portion of the smaller unacceptable token discriminating portion B. However, the low guide wall is not so high as to support or keep tokens from falling from the cut-away portion 6. The low guide wall is provided to merely guide a lower portion of rolling tokens.

Figure 5:
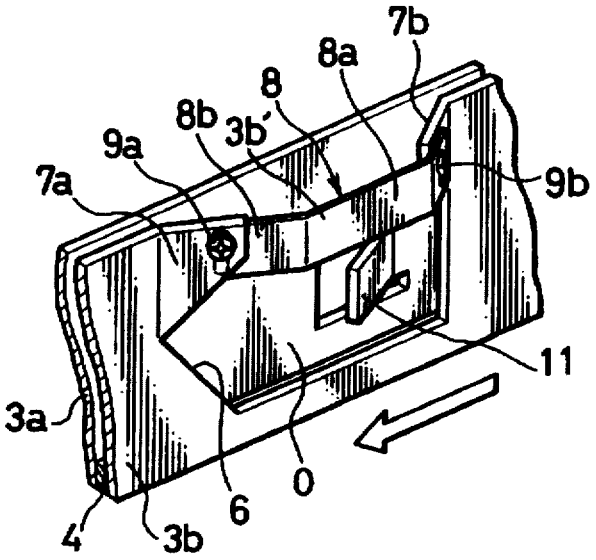
FIG. 5 is a perspective view showing an enlarged essential part of a smaller unacceptable token discriminating portion of the token discriminating device.

The deflective wall 3*b*' is formed by a band member 8 and support arm portions 7*a* and 7*b*. As shown in FIG. 5, the support arm portions 7*a* and 7*b* are provided in an upper portion of the cut-away portion 6. The support arm portion 7*a* extends from a downstream side of the cut-away portion 6 while the support arm portion 7*b* extends from an upstream side of the cut-away portion 6. Also, the support arm portions 7*a* and 7*b* are bent outward from the guide wall 3*b*. Further, the support arm portion 7*a* is formed with a through-hole for passing a screw 9*a* and the support arm portion 7*b* is formed with a thread hole for engaging with a screw 9*b*. The screws 9*a* and 9*b* will be described below.

The band member 8 is attached on the support arm portions 7*a* and 7*b*. The band member 8 has an intermediate portion 8*a*, a downstream portion 8*b*, and an upstream portion 8c. The downstream and upstream portions 8b and 8c are respectively formed with oblong holes 10a and 10b. The oblong holes 10a and 10b extend in a vertical direction.

The upstream portion 8c is bent inward at the same angle as the support arm portion 7b and is releasably attached onto an outer surface of the support arm portion 7b by engaging the screw 9b passing through the oblong hole 10b with the threaded hole formed in the support arm portion 7b. The downstream portion 8b is bent inward at the same angle as the support arm portion 7a and is releasably attached to an inner surface of the support arm portion 7a by engaging the screw 9a passing the through-hole formed in the support arm portion 7a with a plate nut provided on an inner surface of the downstream portion 8b.

In this way, a discriminating opening O is defined by the cut-away portion 6 and the band member 8. The band member 8 is set in such a position that a discriminating distance between a bottom end of the band member 8 and the top surface of the bottom member 4 is slightly smaller than the diameter of the acceptable token. Accordingly, unacceptable token having a diameter smaller than the discriminating distance are fallen off from the discriminating opening O because there is not any portion for keeping the unacceptable small token from falling. The discriminating distance is changed by releasing the screws 9a and 9b and sliding the band member 8 vertically along the oblong holes 10a and 10b.

Also, the upstream portion 8c of the band member 8 is attached onto the outer surface of the support arm portion 7b while the downstream portion 8b is attached onto the inner surface of the support arm portion 7a. In other words, in the upstream of the band member 8, the support arm portion 7b is positioned inside relative to the band member 8. In the downstream of the band member 8, the band member 8 is positioned inside relative to the support arm portion 7a. This arrangement will assure smooth rolling of a token because there is no likelihood that a rolling token comes into contact with an upstream end edge of the band member 8 and with an upstream end edge of the support arm portion 7a. and then halts rolling at these end edges.

The deflector 11 is formed in the guide wall 3a at a position opposite to the discriminating opening O of the cut-away portion 6. The deflector 11 is projected in the rolling passage 5 so as to deflect a rolling token to the discriminating opening O. This will ensure the discrimination of unacceptable token having a smaller diameter than the discriminating distance. The defector 11 is formed by making a cut in the specified portion of the guide wall 3a and bending the cut portion inward.

The deflective wall 3b' is formed by the combination of the outward-bent support arm portions 7a, 7b and the outward-bent band member 8. Accordingly, although the deflector 11 is fixedly projected in the rolling passage, there is no likelihood that the rolling token is stopped at the deflector 11 because the rolling token inclines to the deflective wall 3b'.

Next, an operation of the token discriminating device of this invention will be described.

A token is inserted in the token inlet passage W formed in the larger unacceptable token discriminating portion A where it is discriminated whether the inserted token is larger than the predetermined diameter of the acceptable token. Specifically, if the inserted token is larger than the predetermined diameter, the inserted token is blocked from passing at the discriminating throat T which is defined by the lower right corner 15a of the upper restrictive member 15 and the slanting surface 12a of the lower restrictive member 12 and is set at a distance D equal to or slightly larger than the diameter of the acceptable token. On the other hand, if the inserted token is smaller than the predetermined diameter, the inserted token passes through the discriminating throat T of the larger unacceptable token discriminating portion A.

Figure 6:
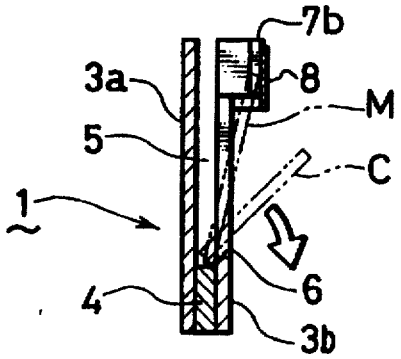
FIG. 6 is a sectional view taken along the line VI—VI in FIG. 1, showing a discriminating operation of the token discriminating device.

The passed token rolls down in the rolling passage 5 to the smaller unacceptable token discriminating portion B where it is discriminated whether the token is smaller than the predetermined diameter of the acceptable token. Specifically, the rolling token comes into contact with the deflector 11. Consequently, the rolling token is inclined toward the discriminating opening O formed in the smaller unacceptable token discriminating portion B. As shown in FIG. 6, the acceptable token M, even when being inclined toward the discriminating opening O, is prevented from falling from the discriminating opening O by the band member 8, and then passes the smaller unacceptable token discriminating portion B. However, the unacceptable token C having a diameter smaller than the discriminating distance is fallen from the discriminating opening O by the deflecting force of the deflector. In this way, unacceptable tokens are discriminated off in the smaller unacceptable token discriminating portion B.

When using acceptable token having a different size or diameter, the lower restrictive member 12 in the larger unacceptable token discriminating portion A is slidingly moved in the lengthwise direction of the rolling member 2 to vary the distance D of the discriminating throat T, or the band member 8 in the smaller unacceptable token discriminating portion B is vertically moved to adjust the discriminating distance.

Tokens which have passed the smaller unacceptable token discriminating portion B are judged to be the acceptable token and supplied to an appropriate portion of the game.

In the above-mentioned embodiment, the discriminating opening O of the smaller unacceptable token discriminating portion B is defined in one of the two guide walls defining the rolling passage 5, i.e., the guide wall 3b, by the cut-away portion 6 and the band member 8. Also, the deflector 11 is fixedly formed in the opposite guide wall 3a at a position facing the discriminating opening O. The rolling token is forcibly inclined to the discriminating opening O by the deflector 11, and is then discriminated in the discriminating opening O whether or not to have a smaller diameter than the diameter of the acceptable token. Accordingly, since the rolling token is forcibly inclined to the discriminating opening O, the discrimination is reliably carried out irrespective of its installation state.

Also, the discriminating device does not have any moving parts. Accordingly, the construction is very simple and little wear occurs, which thus makes it possible to reduce the production costs and to eliminate maintenance service.

Further, the size of the discriminating opening O is changed merely by releasing the screws 9a, 9b and sliding the band member 8 in the vertical direction. Accordingly, the token discriminating device of the invention can be used for a wide variety of game machines each using different size tokens.

Moreover, on upstream of the smaller unacceptable token discriminating portion B is provided the larger unacceptable token discriminating portion A. The larger unacceptable token is prevented from rolling down to the smaller unacceptable token discriminating portion B. Accordingly, larger and smaller unacceptable tokens can be both discriminated off reliably.

In the foregoing embodiment, the deflector 11 is formed by making a cut in a middle portion of the guide wall 3a and bending the cut portion inward. However, according to the invention, it may be appreciated to bulge an upper end portion of the guide wall 3a into the rolling passage 5 to form a deflector, or to fixedly attach a properly shaped block onto an inner surface of the guide wall 3a to form a deflector.

Also, in the foregoing embodiment, there is provided a single smaller unacceptable token discriminating portion B. However, according to the invention, a plurality of smaller unacceptable token discriminating portions may be provided step by step in the lengthwise direction of the rolling member 2 to sort smaller unacceptable tokens in accordance with their sizes. For example, in order of the rolling direction, there are provided a first discriminating portion having a smallest discriminating opening O for discriminating off smallest unacceptable token, a second discriminating portion having an intermediate discriminating opening O for discriminating off intermediate small tokens, and a third discriminating portion having a relatively large discriminating opening O for discriminating off relatively large tokens.

Further, in the foregoing embodiment, the discriminating distance of the smaller unacceptable token discriminating portion B is constant in the rolling direction. However, according to the invention, the discriminating distance of a single smaller unacceptable token discriminating portion B may be changed in the rolling direction to sort smaller unacceptable tokens in accordance with their sizes. For example, in order of the rolling direction, the discriminating distance of a single smaller unacceptable token discriminating portion is made to be smallest at an upstream portion to discriminate off smallest unacceptable token, and is made to be intermediate at an intermediate portion to discriminate off intermediate small tokens, and is made to be relatively large at a downstream portion to discriminate off relatively large tokens.

Although the present invention has been fully described by way of example with reference to the drawings, it is to be understood that various changes and modifications will be apparent to those skilled in the art. Therefore, unless otherwise such changes and modifications depart from the scope of the invention, they should be construed as being included therein.

What is claimed is:

1. A token discriminator device for discriminating large and small diameter tokens comprising:

channel means forming a rolling path in which said tokens pass, said channel means including a bottom and two generally parallel guide walls each having an inner guide surface;

an opening in one of said guide walls, said opening having an upper part;

a deflective wall at said upper part extending outwardly of said inner guide surface of said one guide wall; and a deflector on said other guide wall extending inwardly of said inner guide surface of said other guide wall for deflecting said tokens toward said deflective wail such the large diameter tokens contact said deflective wall and the smaller diameter tokens pass under said deflective wall and through said opening.

2. A token discriminating device according to claim 1 wherein said one guide wall includes deflective wall supports juxtaposed to said upper part of said cut-away portion, and fastening means fastening said deflective wall to said deflective wall supports.

3. A token discriminating device according to claim 2 wherein said inner guide surfaces of said one and said other guide walls are generally planar surfaces which define said rolling path, said deflective wall supports extending outwardly of said inner planar surface of said one guide wall.

4. A token discriminating device according to claim 2 wherein said deflective wall has two end portions and an intermediate portion, said fastening means adjustable fastening said two end portions to said deflective wall supports.

5. A token discriminating device according to claim 1 wherein said one guide wall has a first outwardly extending part on the upstream side of said cut-away portion and a second outwardly extending part on the downstream side of said cut-away portion, said first outwardly extending part sloping outwardly of said inner surface of said one guide wall in a downstream direction, said second outwardly extending part sloping inwardly toward said inner surface of said one guide guide wall in a downstream direction.

6. A token discriminating device according to claim 1 wherein said one guide wall includes upstream and downstream support arms juxtaposed to said upper part of said opening with each support arm being bent outwardly from said one guide wall and with each support arm having an inner and an outer surface, said deflective wall having upstream and downstream end portions with each end portion having inner and outer surfaces, first fastening means fastening the outer surface of said upstream support arm to the inner surface of said upstream end portion of said deflective wall, and second fastening means fastening the inner surface of said downstream support arm to the outer surface of said downstream end portion of said deflective wall.

7. A token discriminating device according to claim 1 wherein said deflector comprises a cut-away portion in said other guide wall in which the cut-away portion is bent inwardly of said inner surface of said other guide wall.

8. A token discriminating device for discriminating large and small size tokens comprising:

channel means defining a path in which tokens pass, said channel means including a bottom and two generally parallel guide walls each having an inner surface;

a cut-away portion in one of said guide walls, said cut-away portion having an upper part;

a deflective wall at said upper part of said cut-away portion, said deflective wall having an intermediate section disposed outwardly of said inner surface of said one guide wall; and a deflector on said other guide wall extending inwardly of said inner surface of said other guide wall and operable to deflect said large size tokens outwardly of inner surface of said one guide wall toward said deflective wall to engage said deflective wall and to deflect said small size tokens outwardly of said inner surface of said one guide wall toward said deflective wall to pass underneath said deflective wall into said cut-away portion.

9. A token discriminating device according to claim 8 wherein said deflective wall has a first part upstream of said intermediate portion and a second part downstream of said intermediate portion, said first part sloping outwardly of said inner surface of said one guide wall in a downstream direction, said second part sloping inwardly toward said inner surface of said one guide wall in a downstream direction.

10. A token discriminating device according to claim 9 wherein said second part is longer than said first part.

11. A token discriminating device according to claim 9 wherein said intermediate portion is spaced from and generally parallel to said inner surface of said one guide wall.

12. A token discriminating device for discriminating large and small diameter tokens comprising:

a channel structure defining an elongated rolling passage in which tokens are rolled, said channel structure including two guide walls;

discriminating means on said channel structure for precluding smaller unacceptable tokens from passing along said rolling passage, said discriminating means including a cut-away portion in one of said guide walls, said cut-away portion having an upper part, a deflective wall provided at said upper part, said deflective wall extending outwardly of said one guide wall and having a lower edge space from said bottom of said channel means a discriminating distance, said lower edge of said deflective and said bottom of said channel structure partly defining a discriminating passage having a height equal to said discriminating distance, said discriminating distance being substantially equal to the largest diameter of said smaller unacceptable tokens to thereby permit passage of said smaller unacceptable tokens through said discriminating passage while precluding tokens having a diameter larger than the largest diameter of said smaller unacceptable tokens from passing through said discriminating passage, and a deflector in said other guide wall at a position facing said discriminating passage for deflecting tokens toward said discriminating passage.

13. A token discriminating device according to claim 12 further comprising adjusting means for adjusting said discriminating distance.

* * * * *